US005806535A

United States Patent [19]

Becker

[11] Patent Number: 5,806,535

[45] Date of Patent: Sep. 15, 1998

[54] FOUNDATIONS FOR HEAD COVERINGS

[75] Inventor: Goldia L. Becker, Pompano Beach, Fla.

[73] Assignee: True Silver Corpoation, Miami, Fla.

[21] Appl. No.: 715,209

[22] Filed: Sep. 17, 1996

Related U.S. Application Data

[63] Continuation-in-part of Ser. No. 554,675, Nov. 7, 1995, abandoned.

[51] Int. Cl.[6] ..... A41G 5/00

[52] U.S. Cl. ..... 132/54; 132/53; 2/171

[58] Field of Search ..... 132/53, 54, 56, 132/274, 201; 2/181, 171, 172, 202, 207, 209.12; D28/39, 40, 41, 42, 43

[56] References Cited

U.S. PATENT DOCUMENTS

| | | | |
|---|---|---|---|
| 2,889,559 | 6/1959 | Lyon, Jr. . | |
| 3,460,546 | 8/1969 | Abbott . | |
| 3,474,798 | 10/1969 | Tilotson . | |
| 3,521,648 | 7/1970 | Capparelli et al. | 132/54 |
| 3,782,396 | 1/1974 | Tomlinson | 132/53 |
| 3,910,292 | 10/1975 | Izzo | 132/54 |
| 4,406,296 | 9/1983 | Wexler et al. . | |
| 4,491,985 | 1/1985 | Dalton | 2/172 |
| 4,599,749 | 7/1986 | Childs et al. . | |
| 4,691,389 | 9/1987 | Meyer . | |
| 4,745,933 | 5/1988 | Saenger . | |
| 4,804,003 | 2/1989 | Moen . | |
| 5,062,157 | 11/1991 | Muta | 2/171 |
| 5,337,763 | 8/1994 | Haber et al. . | |
| 5,379,782 | 1/1995 | Tabb . | |
| 5,509,145 | 4/1996 | Stevenson et al. . | |
| 5,594,956 | 1/1997 | Barrientos | 2/207 |
| 5,617,584 | 4/1997 | Brennan | 2/207 |

*Primary Examiner*—Gene Mancene
*Assistant Examiner*—Pedro Philogene
*Attorney, Agent, or Firm*—Lowe Hauptman, Gopstein Gilman & Berner

[57] ABSTRACT

A head covering foundation article for carrying a head voering, such as a wig, includes a stretchable net-like head band having a circumference approximately equal to the circumference of the head. The band is stretchable circumferentially and between top and bottom edges thereof to conform with the shape of the head of the person. The band top edge has a diameter less than the bottom edge. Each circumferential elasticized reinforced band edge includes an elasticized strip having loops adapted to be gripped by hook fabric fasteners of the VELCRO type on the head covering. The head covering comprises assemblies with hair extending upwardly and downwardly from both of the strips to simulate nape, forehead and crown hair. A scarf wrapped around the foundation article conceals the foundation article.

21 Claims, 5 Drawing Sheets

FOUNDATIONS FOR HEAD COVERINGS

RELATED APPLICATION

The present application is a continuation-in-part of my application Ser. No. 08/554,675, filed Nov. 7, 1995, now abandoned.

TECHNICAL FIELD

The present invention relates generally to foundations for head coverings and more particularly to a head covering foundation including an elasticized net-like band for encircling a head of a user, wherein the band has (1) a circumference approximately equal to the circumference of the head, (2) reinforced elasticized edges, and (3) is stretchable circumferentially and between its top and bottom edges to conform with the shape of the head and be held in place on the head.

BACKGROUND ART

Head coverings, such as wigs, scarves, hats, turbans and the like, are frequently used for cosmetic appearance enhancement. These head coverings are used by persons having full heads of hair, as well as persons having virtually no hair because they suffer from alopecia or are undergoing chemotherapy or radiation treatments for cancer. Frequently hairpieces are held in place by hair clips and combs attached between the hairpieces and the hair of the wearers. Hairpieces also frequently are tightly fitted to the head of the wearer so they remain in place by a friction fit. Wigs are sometimes held in place by various special structures and materials mounted thereon. These head coverings are also sometimes held in place by adhesives attached to the coverings and the head of a wearer, particularly when the wearer has no hair.

These known and sometimes used prior art structures are disadvantageous for those having hair, as well as those who are bald. For both types of wearers, the scalp has a tendency to become overly sensitive to the head covering and/or the head covering causes discomfort to the wearer. In one arrangement, a tight friction fit between the wig is provided by adjustable closures that permit the head covering to be tightened about the perimeter of the head. This structure and other tightly fitting devices tend to cause headaches and other discomfort to the wearer because, inter alia, of the relatively high pressures exerted by the device on the head of a wearer. Alternative head coverings to wigs, such as hats, turbans and scarves, do not usually provide adequate comfort and do not completely conceal the baldness of the subject.

There are numerous prior art patents disclosing various devices for maintaining a wig or other hairpiece or head covering in place. None of these devices, to my knowledge, has been commercialized.

Tillotson, U.S. Pat. No. 3,474,798 discloses a wig girdle or foundation made of a strip of soft resilient resin material, such as foamed polyethylene, foamed polychloride, foamed styrene or foamed rubber. The flexible material encircles and is sized to fit the head of the wearer. Apparently, the Tillotson wig girdle is not made of an elasticized material and fits somewhat loosely about the head of the wearer, being secured in place by "clippies" which are attached to the wig and extend between the wig and the user's hair. As such, this Tillotson structure is completely unsuitable for bald persons and would appear to be difficult to use by persons having natural hair.

Saenger, U.S. Pat. No. 4,745,933 discloses an accessory item formed as a circular, elastic band of toweling to be located approximately midway between an open end and closed, crown end of a wig foundation cap. Filler of differing amounts is placed in an opening of the cap near the elastic band. The amount of filler is adjusted for the needs of a particular wearer. The foundation cap is placed over the toweling accessory item to provide the hairpiece foundation. A wig, i.e., hairpiece, is pulled onto the foundation cap at the forehead and down at the sides and rear. The wig normally fits at the top of the ears and flattened sections of the foundation provide space for a snug fit. The wig is held in place against the scalp forward and below the rolled section and may be attached by bobby pins to the foundation cap.

The Saenger foundation cap would appear to be difficult to use because it requires the hair of the user to be rolled about the absorbent toweling material. The Saenger foundation is also difficult for those who are bald or nearly bald or for those with very fine hair that cannot be wound around the absorbent toweling material because of the manual dexterity required to put the pre-rolled and filled toweling section in place so it acts as a barrier over which the elastic open end of the foundation cap is placed.

Other prior art patents disclosing hairpieces that are removably attached to head coverings are: Haber, U.S. Pat. No. 5,337,763, disclosing a cap with a wiglet for bangs; Moen, U.S. Pat. No. 4,804,003, disclosing a cap with fringe hair at its nape; Childs et al., U.S. Pat. No. 4,599,749, disclosing a hat; Tomillson, U.S. Pat. No. 3,782,396, disclosing a scarf; Abbott, U.S. Pat. No. 3,460,545, disclosing a boudoir cap; and Blair, U.S. Pat. No. 2,889,556. However, none of these head coverings gives the appearance of a full head of hair, and none have, to my knowledge, been commercialized.

It is, accordingly, an object of the present invention to provide a new and improved head covering foundation, particularly adapted for users with little or no hair, but which can also be used by persons having a normal head of hair and who desire to use wigs or other head coverings.

Another object of the invention is to provide a new and improved head covering foundation, particularly adapted to have wigs secured to it in such a manner that the wearer does not become uncomfortable due to various factors, such as (1) heat buildup on the scalp due to the wig, (2) itching, (3) headaches due to tightness of the wig and (4) the psychological trauma associated with a fear of the wig not remaining in place.

A further object of the invention is to provide a new and improved head covering foundation with a structure for securely holding a wig or other head covering in place, without using large noticeable and/or difficult to use fasteners, such as bobby pins, hair clips and combs.

A further object of the invention is to provide a new and improved head covering foundation for enabling different hairpieces to be selectively and easily secured to the foundation.

An additional object of the invention is to provide a new and improved head covering foundation made of relatively inexpensive and readily available material.

A further object of the invention is to provide a new and improved head covering foundation arranged so different head coverings are easily placed on the foundation and the foundation, itself, is easily placed in situ on the head of the wearer.

Another object of the present invention is to provide a new and improved wig foundation arranged so an observer does not realize the wearer is wearing a wig.

SUMMARY OF THE INVENTION

These and other objects of the invention are achieved by providing a head covering foundation article particularly adapted for use on a head of a person who is sufficiently bald so the person has insufficient hair to attach a wig to the hair but which can also be used by others as a hairpiece carrier, wherein the article comprises an elasticized net-like band for encircling the head. The band has a circumference approximately equal to the circumference of the head and reinforced elasticized edges. The band is stretchable circumferentially, i.e., about the circumference of the head, and between top and bottom edges thereof to conform with the shape of the head of the person. The band is arranged to carry a head covering, such as a wig, for the person.

In a preferred embodiment, the band is tapered between its top and bottom edges so the top edge has a diameter less than the bottom edge, to conform more closely with the circumference of the head. The elasticized reinforced edges include elasticized strips having loops, somewhat similar to the loops of a loop and hook fabric fastener, e.g., as sold under the VELCRO® trademark. Hairpieces carrying hook fasteners, e.g., as sold under the VELCRO® trademark, are selectively, at will, attached to the loops. The head covering can be in the form of real or synthetic hair that extends upwardly and downwardly from the strips to simulate the nape and forehead hair of a wearer and the hair on the crown of a wearer's head. When such hairpieces are fastened to the foundation, a scarf or other head covering is wrapped around the foundation article to conceal the existence of the foundation article from an observer. Alternatively, a full wig, including crown hair, nape hair and forehead hair can be held in place on the foundation article, even though the wig does not include VELCRO-type fasteners. This is because the loops on the strips and conventional wigs have sufficient adhesive properties to provide adequate frictional forces to hold the wig in place on the foundation.

In one embodiment, opposite ends of the band are sewn together along a seam that is covered by a strip of flat seam binding tape which extends between the band edges so the end is closed. A similar seam binding tape is sewn between the band edges at a location approximately diametrically opposite from the seam tape which covers the seam, to provide stability for the band between its edges. The band can also be open, so opposite ends thereof are selectively connected by a user securing fasteners on them.

Another, alternate arrangement is to secure a cap to the upper edge of the band. Such a cap covers the crown of the head of users having hair, so that the hair of the user is matted down and does not interfere with the contour of a crown covering wig, hairpiece, or other head covering.

The above and still further objects, features and advantages of the present invention will become apparent upon consideration of the following detailed description of specific embodiments thereof, especially when taken in conjunction with the accompanying drawings.

PREFERRED EMBODIMENTS OF THE PRESENT INVENTION

Figure 1:
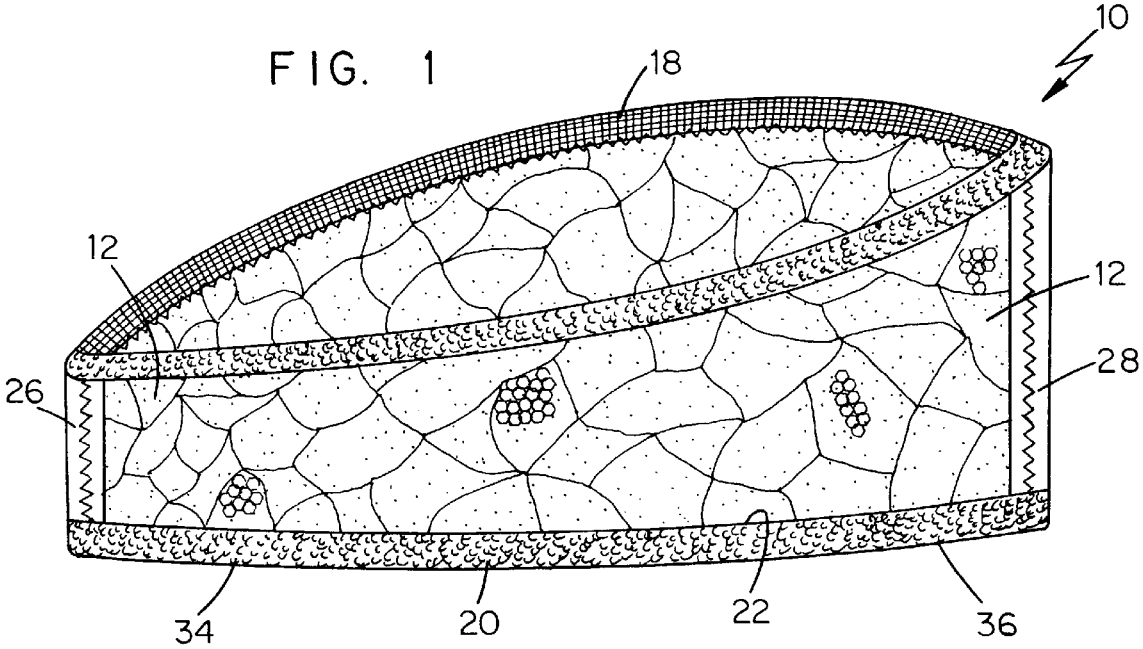
FIG. 1 is a side view of a preferred embodiment of the foundation article of the present invention.
Figure 1A:
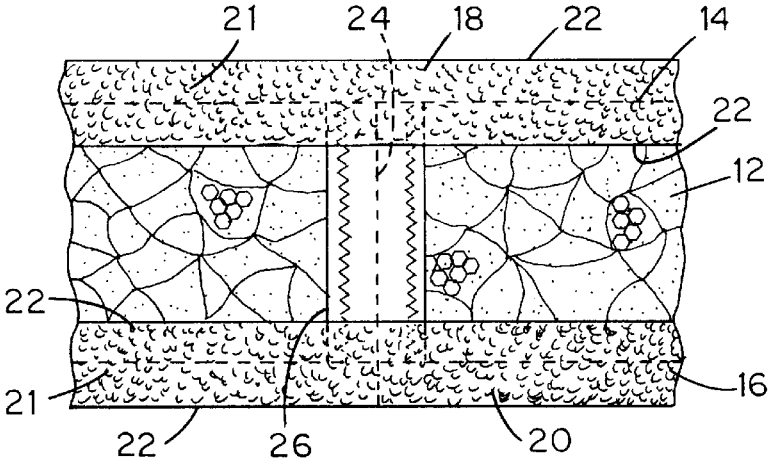
FIG. 1*a* is a view of an exterior portion of the foundation article illustrated in FIG. 1, adapted to be positioned in proximity to the nape of the neck of a wearer.
Figure 1B:
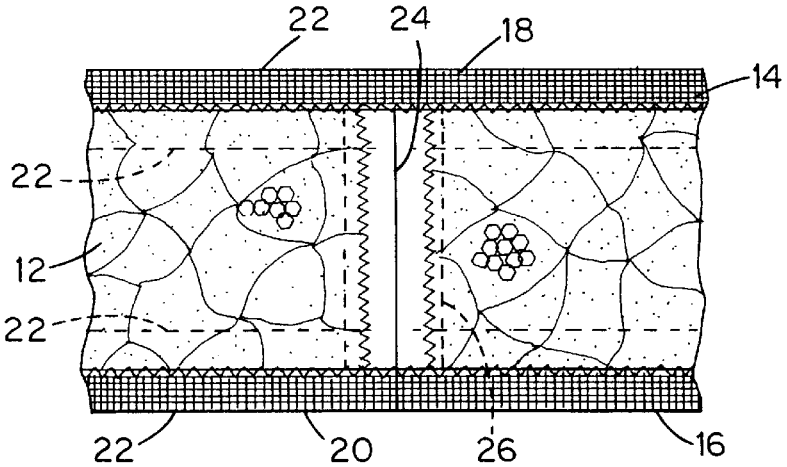
FIG. 1*b* is an interior view of the foundation article illustrated in FIG. 1, adapted to be positioned in the vicinity of the nape of the neck.

Reference is now made to FIGS. 1, 1*a* and 1*b*, wherein head covering foundation article 10 that is particularly adapted to carry a head covering for a person who has insufficient hair to attach a wig is illustrated as including elasticized, lace and net-like woven fabric band 12 having a circumference approximately equal, but somewhat smaller, than the head of a typical wearer; for typical females and males, band 12 has a circumference of about 18 and 21 inches, respectively. Band 12 is preferably made of the same fabric as women's foundation garments, e.g., underpants, slips and brassieres, with its principal materials being nylon and elastic fabric threads, sewn together in the same manner as lace, so the fabric does not include a weft and warp. The elastic fabric in band 12 is preferably made of the material known by the trademark SPANDEXTRA. The material of band 12 is stretchable in two dimensions, so it can stretch (1) circumferentially about the circumference of the head of the wearer and (2) between its reinforced, elasticized top and bottom edges 14 and 16 (FIGS. 1*a* and 1*b*). Usually when the foundation article 10 of FIG. 1 is placed on the head of a wearer, bottom edge 16 runs generally along the hairline of the head of the wearer, while top edge 14 is considerably below the crown of the head of the wearer.

There is preferably a smooth and constant variation in the width of band 12 between its edges 14 and 16 so the width of the band is greatest at the forehead of the wearer and is least at the nape of the neck of the wearer. To provide optimum fit of foundation article 10 on the head of the wearer, band 12 is preferably, but not necessarily, tapered between top edge 14 and bottom edge 16, a result achieved by the diameter of the top edge being somewhat less than the diameter of the bottom edge 16. Typically, the top portion diameter is about three-eighths of an inch less than the bottom edge diameter.

The entireties of each of circumferential edges 14 and 16 are respectively sewn to elasticized top and bottom fabric binding strips 18 and 20 which have a greater elasticity than band 12 and assist in providing stability for band 12 between edges 14 and 16 and enhance the band elastic properties. A central portion of each of binding strips 18 and 20 is sewn to exterior edges 14 and 16 of band 12, respectively, so the exterior circumferential selvage edges 22 of the binding strips extend above and below the band edges so edges 22 are not sewn or otherwise connected to band 12. Strips 18 and 20 carry loop material 21 between edges 22 of the strips in such a manner that the loop material faces outwardly and is remote from band 12, to facilitate fastening and carrying of head coverings, such as real or synthetic hairpieces, as described in detail infra. The real or synthetic hairpieces or other head coverings preferably include strips having hook fabric fasteners, e.g., as sold under the VELCRO trademark which engage the loops 21 on strips 18 and 20. The back faces of strips 18 and 20 abutting and sewn directly to band 12 are made of conventional elasticized woven fabric material having interlaced weft and warp threads. In one preferred embodiment, each of strips 18 and 20 has a width between edges 22 of about three-quarters of an inch.

In the embodiment of FIGS. 1, 1*a* and 1*b*, opposite ends of band 12 are sewn together at seam 24 that extends completely across the width of the band between circumferential edges 14 and 16. Seam 24 is preferably located at the portion of band 12 that is to be placed at the nape of the neck of the wearer, where the spacing between edges 14 and 16 is a minimum, typically about 2 inches. Seam 24 is covered by a strip of flat seam binding tape 26, sewn along its opposite edges to the face of band 12 between edges 14 and 16 so the ends of tape 26, at a position coincident with edges 14 and 16, are sewn to and covered by strips 18 and 20.

A strip of flat seam binding tape 28 is sewn to a portion of the exterior face of band 12 diametrically opposite from seam 24 and tape 26. The ends of strips 18 and 20 are conveniently positioned at tapes 26 and 28 and are sewn to tapes 26 and 28. Tape 28 is preferably located at the portion of band 12 that is to be placed at the forehead of the wearer, where the space between edges 14 and 16 is a maximum, typically about 3 inches. Tapes 26 and 28 help to stabilize the width of band 12 between its edges 14 and 16 to resist excessive stretching of the fabric of the band across its width between edges 14 and 16 and provide a soft and aesthetically pleasing finish for the band, particularly for seam 24. Tapes 26 and 28 are also visual guides for placement of foundation article 10 on the head of the wearer.

The foundation article 10 illustrated in FIGS. 1, 1*a* and 1*b* can be used with a conventional wig or with special hairpieces, as described infra. It has been found through actual experimentation that when a conventional wig is placed on foundation article 10 that the wig is immobilized to a much greater extent than normal, without the wig being secured to any hair the wearer may have. Hence, the wig wearer who has hair does not have the discomfort of a fastener connected to her hair. If the wearer has no hair, the psychological trauma associated with the wig moving is removed. In addition, users with and without hair have found that the head appears to be cooler when a wig or other hairpiece is mounted on foundation 10 than when a wig or other hairpiece is applied directly to the head. In addition, itching frequently associated with wig wearing is not usually present when a wig or other head covering is secured to foundation 10. These results probably occur because the wig or other head covering placed on foundation article 10 appears to be spaced by the foundation article from a major portion of the scalp of the wearer. Wig wearers who have used foundation article 10 have found that headaches associated with other foundation articles do not occur. The lack of headaches is probably because of the lacy nature of band 10 which has a "soft" memory since it is not highly elasticized and has a size and shape approximating the size and shape of the portion of the head of the wearer contacting the band. In contrast, prior art headpiece foundation articles that have caused headaches are made principally of tightly woven nylon and are highly elasticized so they have "hard" memories. In addition, these prior art foundation articles are considerably smaller in circumference than the head of the contacting portion of the head of the wearer so they must be stretched considerably about the head.

Figure 2:
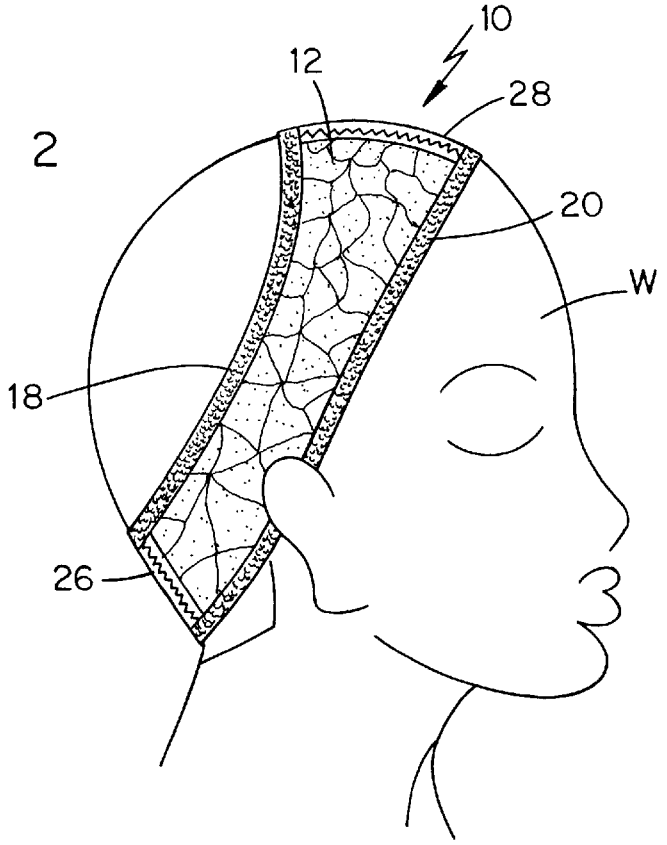
FIG. 2 is an illustration of the foundation article of FIG. 1 on the head of a female wearer.

Preferably, foundation article 10 is placed on the head of a wearer as indicated in FIG. 2. The lower edge of lower strip 20 passes between the ears and head of wearer W and thence about the nape of the neck and the forehead of the wearer, in general alignment with the normal hairline of the wearer. Relatively short and long strips 26 and 28 are respectively positioned in proximity to the nape and forehead of user W. Pressure is exerted against the head of the wearer by band 12, but a greater pressure is exerted on the head by the greater elasticity of strips 18 and 20. The combined elasticity of band 12 and strips 18 and 20 is such that foundation article 10 is maintained in place on the head of the wearer. The principal compressive forces are exerted by strips 18 and 20 because these strips have greater elasticity than band 12. The pressures exerted on the head by band 12 and strips 18 and 20 are relatively low. The exerted pressures on the head are insufficient to be noticed by the wearer, so that the wearer is not subjected to headaches by pressure from foundation article 10 and quickly forgets that she is wearing the foundation article. The pressures are similar or somewhat less than those exerted by a typical forehead sweatband on a wearer.

Different types of head coverings can be mounted on foundation article 10 in various ways.

Figure 3:
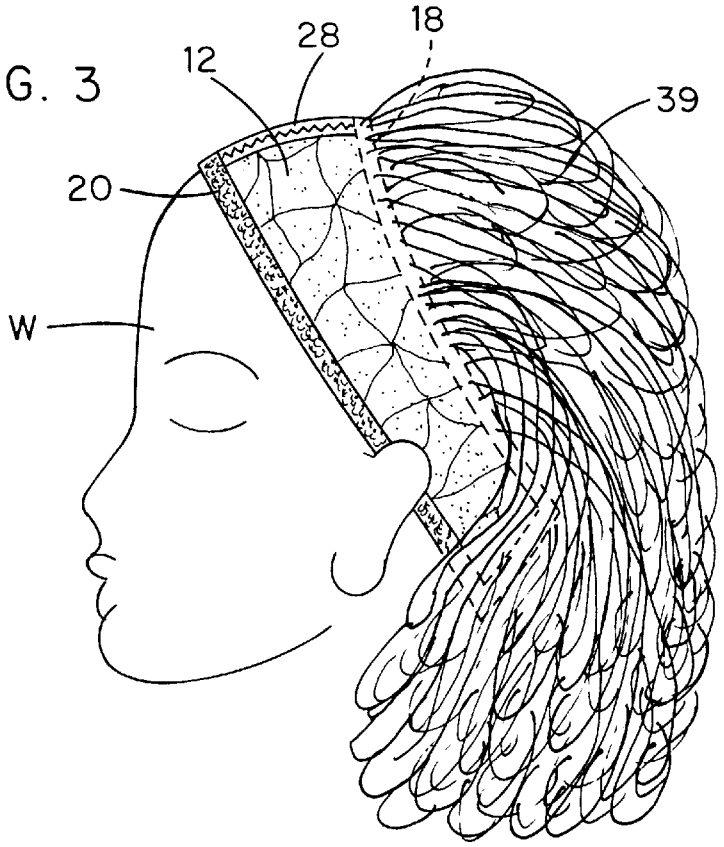
FIG. 3 is a side view of the foundation article of FIG. 1 in place on a wearer's head, with a crown hairpiece fixedly attached by sewing to an elasticized strip on the upper edge of the foundation article.

In the arrangement of FIG. 3, real or synthetic crown hairpiece 39 is sewn on and extends outwardly from upper strip 18 of foundation article 10. Hairpiece 39 covers the entire crown of the head of the wearer. Since hairpiece 39 is carried by upper strip 18, the hairpiece is lifted to a certain extent from the scalp of wearer W. Thereby, the scalp of wearer W is maintained in a relatively cool state, compared to the temperature of the scalp with a conventional wig sitting on it. In addition, itching associated with a fabric liner of a conventional wig is avoided by sewing hairpiece 40 to strip 18.

In other embodiments, as about to be described, different types of hairpieces are selectively, and at will, connected to the loops on the exterior face of upper and lower strips 18 and 20. Assemblies including real or synthetic nape hair and forehead hair are selectively connected to the loops 21 on bottom strip 20 such that the nape hair extends from a region 34 on strip 20 just below the ears and around the neck, while forehead hair is selectively connected to the loops of strip 20 from a region 36 on strip 20 that extends from just above the ears, about the forehead.

Figure 4A:
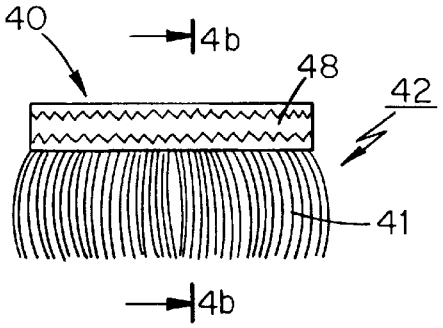
FIG. 4*a* is a front view of a nape hair fringe hairpiece assembly including a fastener strip, e.g., as sold under the VELCRO® trademark, adapted to be attached to loops on an elasticized strip on the bottom edge of the foundation article of FIG. 1.
Figure 4C:
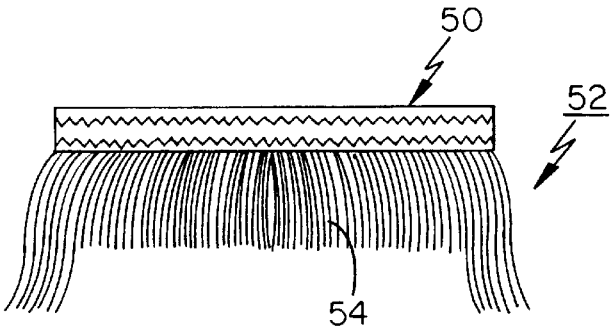
FIG. 4*c* is a front view of a forehead bang fringe hairpiece assembly including a loop fastener strip, e.g., as sold under the VELCRO® trademark, adapted to be attached to loops on the elasticized strip on the bottom edge of the foundation article of FIG. 1.
Figure 4B:
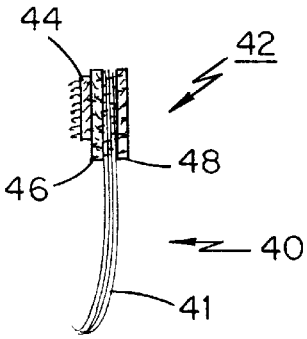
FIG. 4*b* is a side sectional view of the hairpiece assembly of FIG. 4*a*, taken through the lines 4*b*—4*b;*

As illustrated in FIGS. 4*a* and 4*b*, nape hairpiece assembly 40 to be placed on region 34 of strip 20 comprises fabric binder 42, including seam binding tapes 46 and 48 between which the nape hair 41 is sandwiched. The nape hair 41 is held in place between tapes 46 and 48 by being glued and sewn or otherwise fastened to the interior faces of the seam binding tapes, which are also sewn together. Tape 44, e.g., as sold under the VELCRO® trademark, carrying VELCRO-type hooks on its exterior surface is sewn to the exterior face of binding tape 46. The hooks on tape 44 are placed against the loops 21 on the exterior face on region 34 of strip 20 so nape hair assembly 40 is selectively at will secured to the loops on strip 20.

Figure 5:
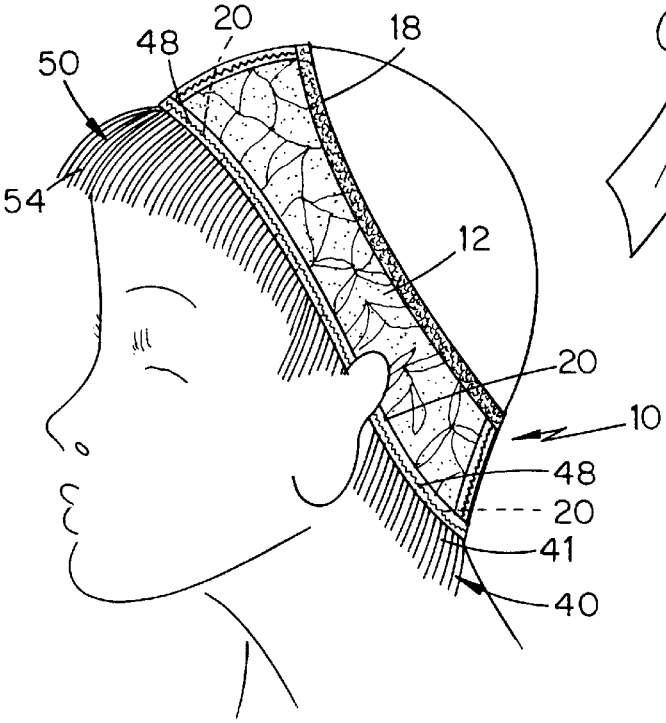
FIG. 5 is a view of a female wearing the foundation article of FIG. 1, with the hairpiece assemblies of FIGS. 4*a* and 4*c* secured to loops on the elasticized strip on the bottom edge of the foundation article.

One embodiment of a forehead covering to be placed on region 36 of strip 20 is illustrated in FIG. 4*c* as including real or synthetic bang hairpiece assembly 50, held together by binding 52 that is constructed in the same way as binding 42 illustrated in FIGS. 4*a* and 4*b*. Hence, bang hairpiece assembly 50 includes a pair of seam binding tapes between which bang hairpiece 54 is sandwiched. One of the seam binding tapes of bang hairpiece assembly 50 carries a tape including a hook-type fastener strip, e.g., as sold under the VELCRO® trademark. The fastener strip of bang hairpiece assembly 50 is connected to the loops at region 36 of strip 20. Foundation article 10 carries the hairpiece assemblies of FIGS. 4*a* and 4*c* on regions 34 and 36 of lower strip 20 that is sewn to the lower edge 16 of band 12 of foundation article 10, as illustrated in FIG. 5.

Figure 6:
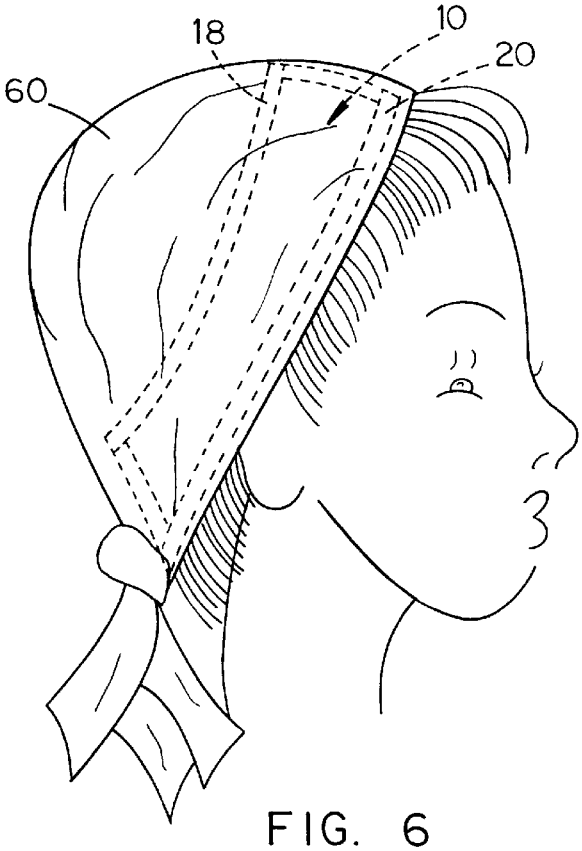
FIG. 6 is a view of a female wearing the foundation article of FIG. 1, in combination with the hairpiece assemblies of FIGS. 4*a* and 4*c* and a scarf covering the top of the head and the foundation article.
Figure 7:
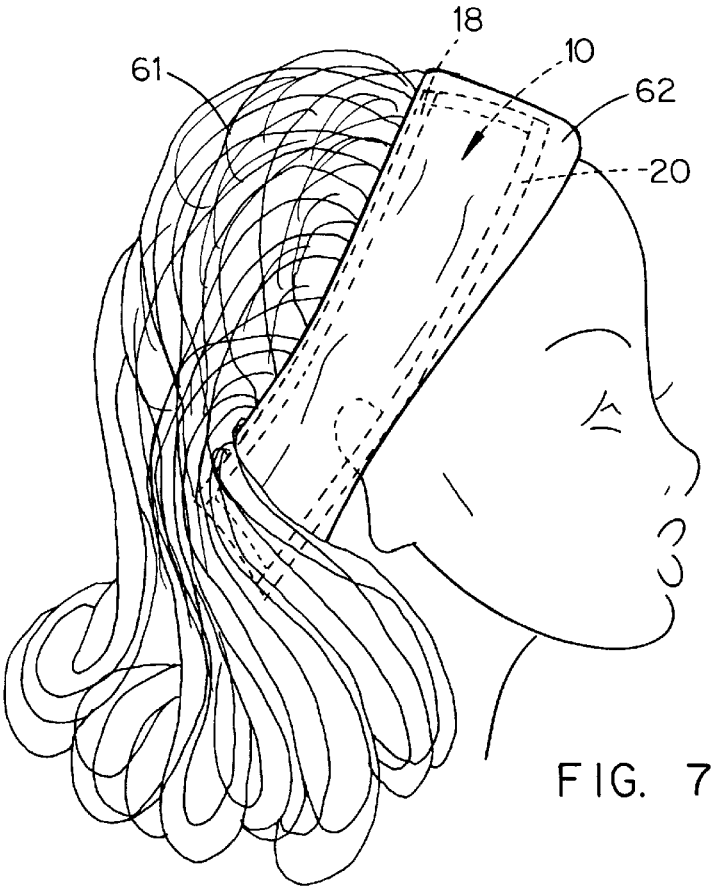
FIG. 7 is a side view of the foundation article of FIG. 1 in place on a head of a wearer with a crown hairpiece including a hook fastener strip, e.g., as sold under the VELCRO® trademark, attached to loops on an elasticized strip on the upper edge of the foundation article and a headband covering the foundation article.

With the hairpieces of FIGS. 4*a* and 4*c* in place on foundation article 10, a wearer has several options as to the type of head covering to use for the crown of the head. As illustrated in FIG. 6, head scarf 60 covers the crown of the head by being tied around the forehead and nape of the neck in a conventional manner, to cover foundation article 10. Thereby, an observer does not realize that wearer W has the hairpieces of FIGS. 4*a* and 4*c* attached to foundation article 10. Alternatively, as illustrated in FIG. 7, crown hairpiece assembly 61, having a binding of the type illustrated in FIGS. 4*a* and 4*b* (i.e., including a hook fastener strip, e.g., as sold under the VELCRO® trademark), is selectively, at will attached to the loops around the circumference of strip 18 on upper edge 14 of band 12 of foundation article 10. The placement of crown hairpiece assembly 61 is thus similar to the placement of the crown hairpiece of FIG. 2, except that in FIG. 7, the crown hairpiece assembly is selectively removable, as a result of the loops on strip 18 and the hook fastener strip of hairpiece 61. When crown hairpiece assembly 61 is attached to foundation article 10 in the manner illustrated and described in connection with FIG. 7, head-scarf 62 or other suitable object is wrapped around the foundation article to hide the foundation article from the view of an observer.

Figure 8:
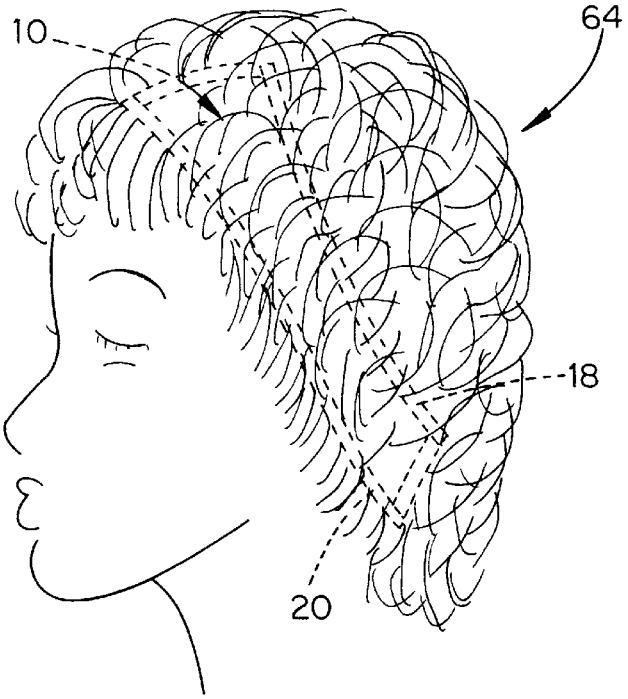
FIG. 8 is a side view of the foundation article of FIG. 1 in place on a wearer's head, with a full wig in place covering the foundation article.

A conventional wig 64 having crown, forehead and nape natural or synthetic hair bound to a liner is also selectively placed on foundation article 10, as illustrated in FIG. 8. When conventional wig 64 is placed on foundation article 10, the foundation article is completely covered by the conventional wig and is therefore hidden from the view of an observer. With a conventional wig in place on foundation article 10, the conventional wig remains in place on the head of a wearer to a much greater extent than when the wig is merely placed on the head of a wearer, particularly wearers who are bald or nearly bald. It has also been found that the head of the wearer is cooler when a conventional wig is placed over foundation article 10 than when the wig is placed on the head without the foundation article and that the wearer experiences virtually no itching when the conventional wig is placed over the foundation article. Apparently there is some adhesion between the loops on the exterior faces of strips 18 and 20, as well as the fabric of band 12, and the fabric of the conventional wig lining to provide a frictional force between the foundation article and the wig, to virtually prevent wig slippage.

Figure 9:
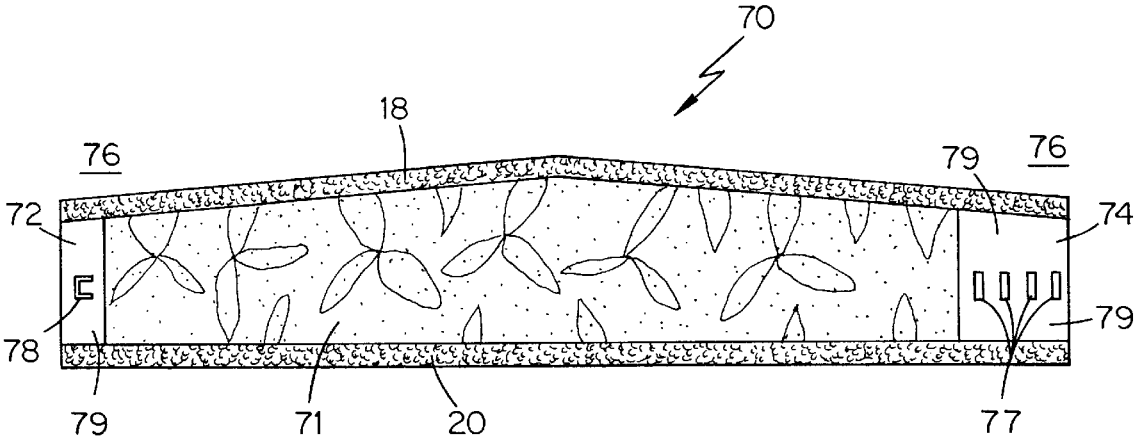
FIG. 9 is a rear, exterior view of a preferred embodiment of a modified foundation article having open ends selectively, at will, connected to each other by a fastener.

The closed foundation article 10 of FIGS. 1, 1*a* and 1*b*, including ends of band 12 that are sewn together at seam 24, can be modified as illustrated in FIG. 9. Foundation article 70, FIG. 9, is, to a large extent, the same as article 10, FIGS. 1, 1*a* and 1*b*, except that band 71 of article 70 has two opposite open ends 72 and 74 that are selectively, at will, fastened together by fastening device 76. Fastening device 76 selectively at will connects ends 72 and 74 at the same place as where seam 24 is sewn on band 12, i.e., at the portion of band 71 to be located adjacent the nape of the neck. Selective, at will, fastening of ends 72 and 74 by fastening device 76 enables foundation article 70 to be fitted more precisely to the head of the wearer than article 10 so the wearer should be more comfortable.

In the preferred embodiment of fastening device 76 illustrated in FIG. 9, fastening device 76 includes four circumferentially spaced wire loops 77 secured toward one end of band 71 and a single wire hook 78 secured at the other end of band 71. Loops 77 and hooks 78, preferably of the type used on brassieres, are located at opposite ends of band 71 by being secured to selvage strips 79 that extend between opposite edges of band 71 and perform the same stabilizing and other functions as seam binding tape 26. It is to be understood that other fastening devices, such as fabric hook and loop strips, of the VELCRO type, can be employed on the open band 31 of FIG. 9.

Figure 10:
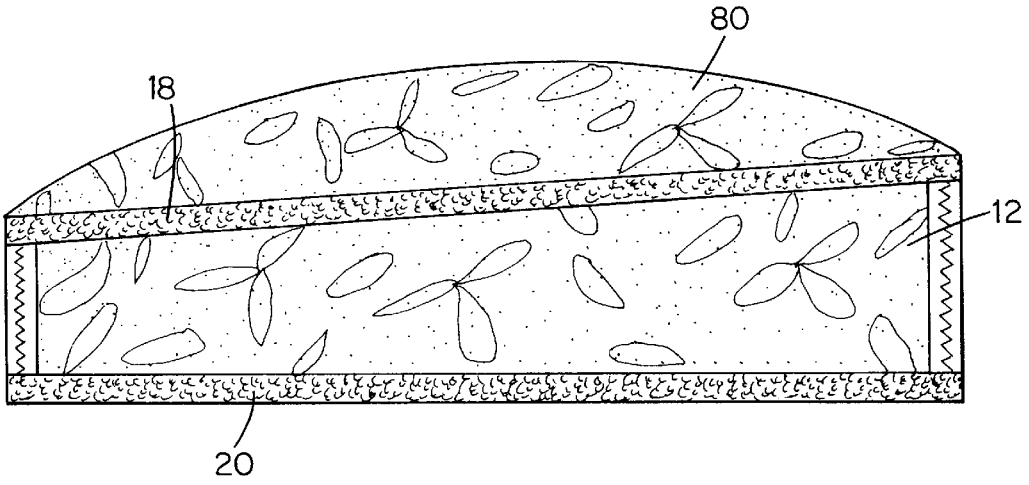
FIG. 10 is a side view of another preferred embodiment of the foundation article, wherein a cap covering the crown of the head of a wearer is sewn to the elasticized strip on the top edge of the foundation article.

Another alternative, illustrated in FIG. 10, involves sewing crown covering cap 80 to top edge 14 of band 12, behind strip 18, or to the inside of upper binding strip 18; in the arrangement, cap 80 is sewn to the inside of strip 18. Cap 80 is preferably made of the same fabric material as band 12 and may provide some users with a greater degree of psychological comfort than a foundation article including only a band, as illustrated in FIGS. 1 and 9. If cap 80 is used by a wearer who has a full head of hair, the cap mats down the hair and provides a more pleasing look to a conventional wig or other head covering that is held in place by the foundation articles of FIG. 1 or 9. If cap 80 is used by a bald wearer, the cap smoothes possible uneven contours in the scalp of the wearer and tends to prevent such contours from being evident to an observer.

While there have been described and illustrated specific embodiments of the invention, it will be clear that variations in the details of the embodiments specifically illustrated and described may be made without departing from the true spirit and scope of the invention as defined in the appended claims.

I claim:

1. A head covering foundation article particularly adapted for use on a head of a person who is sufficiently bald so the person has insufficient hair to attach a wig to the hair and which can be used by others as a hairpiece carrier, the article comprising a stretchable net-type band for encircling the head, the band having a circumference approximately equal to the circumference of the head and reinforced elasticized edges, the band being stretchable circumferentially about the circumference of the head and between top and bottom edges thereof to conform with the shape of the head of the person, the band being arranged to carry a head covering for the person.

2. The head covering foundation article of claim 1 wherein the band is elasticized.

3. The head covering foundation article of claim 2 wherein the band is elasticized less than the edges.

4. The head covering foundation article of claim 3 wherein the band is tapered between top and bottom edges thereof so the top edge has a diameter less than the bottom edge, to conform more closely with the circumference of the head.

5. The head covering foundation article of claim 1 further including a full wig, including crown hair, nape hair and forehead hair held in place on the foundation article in such a manner as to conceal the presence of the foundation article from an observer.

6. The head covering foundation article of claim 1 further including a head covering sewn to one of the elasticized edges.

7. The head covering foundation article of claim 1 wherein each of the elasticized reinforced edges includes an elasticized strip.

8. The head covering foundation article of claim 7 wherein the band is elasticized.

9. The head covering foundation article of claim 8 wherein the band is elasticized less than the strips.

10. The head covering foundation article of claim 1 wherein the band is closed and opposite ends of the band are joined together along a seam that is covered by a strip of flat seam binding tape which extends between the band edges so the end is closed.

11. The head covering foundation article of claim 10 further including another seam binding tape extending between the band edges at a location approximately diametrically opposite from the seam tape which covers the seam, to provide stability for the band between edges thereof.

12. The head covering foundation article of claim 1 wherein the band is open, opposite ends of the band being selectively connected together by fasteners on the opposite ends.

13. The head covering foundation article of claim 1 further including a cap secured to the upper edge of the band, the cap covering the crown of the head, and a crown covering headdress covering the cap.

14. The head covering foundation article of claim 1 wherein the band is tapered between top and bottom edges thereof so the top edge has a diameter less than the bottom edge, to conform more closely with the circumference of the head.

15. The head covering foundation article of claim 1 wherein the net-type material is a lace fabric that does not include a weft and warp.

16. The head covering foundation article of claim 1 further including a headdress, the band and headdress including fabric hooks and loops for fastening the headdress to the band.

17. The head covering foundation article of claim 12 wherein the fasteners are arranged for enabling the band circumference to be adjusted for differing diameter heads.

18. The head covering foundation article of claim 12 wherein the band includes a central portion between the two opposed ends, the central portion having (a) a greater extent between the edges than the ends of the band and (b) seam binding tape sewn to the band to extend in a direction between the edges.

19. The head covering foundation article of claim 1 wherein the foundation article is in combination with a crown head covering, the foundation article and the crown head covering being connected to each other so the crown head covering is spaced by the foundation article from a major portion of a scalp of a bald person.

20. The head covering foundation article of claim 1 further including a headdress fastened in place on the foundation article, the headdress being constructed and arranged and fastened in place on the foundation article to conceal the presence of the foundation article from an observer.

21. The head covering foundation article of claim 1 further including a hairpiece fastened in place on the foundation article, the hairpiece being constructed and arranged and fastened in place on the foundation article to hang down from the foundation article and being in combination with a crown covering headdress to conceal the presence of the foundation article from an observer.

* * * * *